US006558441B1

(12) United States Patent
Sato

(10) Patent No.: US 6,558,441 B1
(45) Date of Patent: May 6, 2003

(54) PROCESS OF UPGRADING LOW RANK COAL

(75) Inventor: Yoshiki Sato, Tsukuba (JP)

(73) Assignee: Agency of Industrial Science and Technology (JP)

( * ) Notice: Subject to any disclaimer, the term of this patent is extended or adjusted under 35 U.S.C. 154(b) by 92 days.

(21) Appl. No.: 09/638,178

(22) Filed: Aug. 14, 2000

(30) Foreign Application Priority Data

Aug. 19, 1999 (JP) ..... 11-232345

(51) Int. Cl.[7] ..... C10L 5/00
(52) U.S. Cl. ..... 44/608; 44/620
(58) Field of Search ..... 44/608, 620

(56) References Cited

U.S. PATENT DOCUMENTS

| | | | | | |
|---|---|---|---|---|---|
| 3,754,876 | A | * | 8/1973 | Pennington | 44/607 |
| 3,926,775 | A | | 12/1975 | Schroeder | 208/10 |
| 4,045,187 | A | * | 8/1977 | Brink | 44/607 |
| 4,144,033 | A | * | 3/1979 | Nakako | 44/607 |
| 4,758,331 | A | * | 7/1988 | Kruse et al. | 208/403 |
| 5,503,646 | A | * | 4/1996 | McKenny | 44/620 |

* cited by examiner

*Primary Examiner*—Cephia D. Toomer
(74) *Attorney, Agent, or Firm*—Lorusso, Loud & Kelly

(57) ABSTRACT

A process of upgrading low rank coal, including subjecting the low rank coal to pyrolysis in a liquid phase such as in an organic solvent at a temperature of 400–450° C.

12 Claims, No Drawings

PROCESS OF UPGRADING LOW RANK COAL

BACKGROUND OF THE INVENTION

This invention relates to a process of upgrading low rank coal.

The amount of low rank coal deposits is estimated to be comparable to that of high rank coal. However, low rank coal is not widely utilized not only because of its low calorific value but also because of its difficulty in transportation and storage attributed to its high water content and spontaneous ignition when dried. A lot of processes have thus far been proposed to upgrade such low rank coal. One known upgrading method is a steam drying method in which a raw coal feed is heated at 120–130° C. with steam. Another method is a pyrolysis method in which low rank coal is placed on a grid and contacted with hot gas to pyrolyze the coal to obtain upgraded coal and tar. A K-Fuel method is also known in which a raw coal feed is dehydrated with steam at 260° C. or less and then heated at 340–430° C. to obtain upgraded coal into which tar produced in situ is impregnated. The upgraded coal does not have a high calorific value.

The conventional processes have the following problems:

(a) upgraded coal still shows spontaneous ignition property and thus is ill-suited for storage and transportation;

(b) the upgraded coal has a significant oxygen content, which gives rise to a problem of $CO_2$ generation;

(c) the oil product has a low content of valuable light fractions such as benzene, toluene, xylene, phenol and cresol.

SUMMARY OF THE INVENTION

It is, therefore, an object of the present invention to provide a process of upgrading low rank coal, which has solved the above-described problems.

Another object of the present invention is to provide a process capable of producing upgraded coal which does not have spontaneous ignition property and which is suitable for transportation and storage.

It is a further object of the present invention to provide an industrially advantageous process which can produce upgraded coal with a high calorific value and a reduced oxygen content but without spontaneous ignition property, and which can produce valuable light oils such as benzene, toluene, xylene, phenol and cresol.

In accomplishing the foregoing objects, the present invention provides a process of upgrading low rank coal, comprising subjecting the low rank coal to pyrolysis in a liquid phase at a temperature of 400–450° C.

Other objects, features and advantages of the present invention will become apparent from the detailed description of the preferred embodiments to follow.

DETAILED DESCRIPTION OF THE PREFERRED EMBODIMENTS OF THE INVENTION

In the process according to the present invention, a low rank coal is pyrolyzed in a liquid phase at a temperature of 400–450° C. to produce a upgraded coal and a light oil.

The low rank coal used in the present invention generally has a rank of coalification of 80% or less. Illustrative of the low rank coal are sub-bituminous coal, brown coal, lignite and peat.

For reasons of facilitating the pyrolysis, it is preferred that the low rank coal be ground to have a particle size of 100 mm or less, more preferably 50 mm or less. If necessary, the low rank coal feed is dried to remove water.

The low rank coal feed is preferably dispersed in the form of a slurry in an organic solvent. The organic solvent is generally used in an amount of 0.5–2 parts by weight, preferably 1–1.5 parts by weight per part by weight of the low rank coal.

Any organic solvent may be used as long as the coal feed can be slurried therein. Illustrative of suitable organic solvents are organic solvent is selected from the group consisting of paraffins, paraffinic kerosene oil, gas oil, lubricating oil fractions and waste oil. The use of a paraffin such as trans-decalin is especially preferred for reasons of high pyrolysis efficiency and easiness in solid-liquid separation of the pyrolyzed products.

The coal slurry is then pyrolyzed. It is important that the pyrolysis should be performed at a temperature of 400–450° C., preferably 420–440° C. When the temperature is less than 400° C., the pyrolysis does not proceed sufficiently so that the yield of light oil fraction is very low. The term "light oil fraction" herein is intended to refer to a fraction having a boiling point in the range of 60–220° C. Such a fraction include aromatic hydrocarbons such as benzene, toluene and xylene and oxygen-containing compounds such as phenol and cresol.

To high a pyrolysis temperature in excess of 450° C. is undesirable because the pyrolysis proceeds excessively so that the liquid phase including the solvent decomposes into gaseous products.

The pyrolysis may be carried out in a closed reactor such as an autoclave which is preferably maintained in an oxygen-free atmosphere such as in a nitrogen atmosphere. The pyrolysis pressure is not specifically limited but is generally in the range of 0.2–7 MPa, preferably 0.5–5 MPa.

If desired, the pyrolysis may be performed in the presence of a catalyst such as a desulfurization catalyst or a denitrification catalyst. Illustrative of such catalysts are iron sulfide, nickel-molybdenum supported on alumina, cobalt-molybdenum supported on alumina and a natural mineral catalyst containing, for example, cobalt and/or nickel.

The following examples will further illustrate the present invention.

EXAMPLE 1

Sub-bituminous coal (Backskin coal produced in U.S.A.) is ground into 100 mesh or less and dried to obtain a coal feed having the properties shown in Table 1. In Table 1, calorific value was measured with a pump calorimeter. Ignition point was measured with a thermogravity/differential thermoanalyzer with an air feed rate of 50 ml/min and a heating rate of 20° C./min.

The coal feed (22 g) was dispersed in 50 g of t-decalin contained in a 200 ml autoclave equipped with a magnetic stirrer. Nitrogen gas was fed to the autoclave until a nitrogen pressure of 2 MPa was reached. The mixture in the autoclave was then reacted at 400° C. for 1 hour. The product was distilled under vacuum at a temperature of 330° C. and a pressure of 3 torr, thereby obtaining a upgraded coal, an oil product and a gas product. The properties of the upgraded coal are shown in Table 1 together with those of the raw coal feed. The yield of the pyrolysis products and the composition of the gas product are shown in Table 2.

TABLE 1

| Properties of Raw Coal Feed and Reformed Coal | Raw Coal Feed | Example 1 | Example 2 | Example 3 | Comparative Example 1 |
|---|---|---|---|---|---|
| Pyrolysis Temperature (° C.) | | 400 | 420 | 440 | 380 |
| Elementary Analysis (wt %) | | | | | |
| C | 71.7 | 79.4 | 82.5 | 85.2 | 77.8 |
| H | 5.4 | 4.5 | 4.6 | 5.0 | 4.9 |
| N | 1.5 | 1.2 | 1.3 | 1.7 | 1.3 |
| O, S, etc. | 21.5 | 14.9 | 11.6 | 8.1 | 16.3 |
| H/C Atomic Ratio | 0.90 | 0.69 | 0.67 | 0.70 | 0.76 |
| Ash Content (wt %, dry basis) | 6.09 | 13.40 | 13.77 | 15.07 | 12.31 |
| Calorific Value (kcal/kg) | 4,610 | 6,640 | 6,850 | 7,440 | 6,950 |
| Ignition Point (° C.) | 372 | 406 | 450 | 523 | 379 |

TABLE 2

| Yield of Pyrolysis Products and Composition of Gas Product | Example 1 | Example 2 | Example 3 | Comparative Example 1 |
|---|---|---|---|---|
| Pyrolysis Temperature (° C.) | 400 | 420 | 440 | 380 |
| Yield | | | | |
| Gas | 6.1 | 8.5 | 11.6 | 4.5 |
| Oil | 1.8 | 3.6 | 8.9 | 1.0 |
| Reformed coal | 88.3 | 82.0 | 74.0 | 89.3 |
| Water | 3.8 | 5.9 | 5.4 | 5.2 |
| Composition of Gas Product | | | | |
| $CO_2$ | 77.2 | 70.5 | 61.7 | 81.9 |
| $CH_4$ | 7.5 | 11.1 | 13.1 | 5.9 |
| $H_2$ | 0.71 | 1.19 | 1.91 | 0.40 |

EXAMPLE 2

Example 1 was repeated in the same manner as described except that the pyrolysis was performed at 420° C. The results are summarized in Tables 1 and 2.

EXAMPLE 3

Example 1 was repeated in the same manner as described except that the pyrolysis was performed at 440° C. The results are summarized in Tables 1 and 2. The oil of the pyrolysis products had a composition shown in Table 3.

TABLE 3

| Composition of Oil Product | |
|---|---|
| Composition of Oil | % by weight |
| Benzene | 3.8 |
| Toluene | 13.4 |
| Phenol | 10.2 |
| o-Cresol | 15.4 |
| m-Cresol | 7.3 |
| p-Cresol | 10.0 |
| 2,6-dimethylphenol | 4.7 |
| Others | 35.2 |

COMPARATIVE EXAMPLE 1

Example 1 was repeated in the same manner as described except that the pyrolysis was performed at 380° C. The results are summarized in Tables 1 and 2.

COMPARATIVE EXAMPLE 2

Example 1 was repeated in the same manner as described except that the pyrolysis was performed at 460° C. Desirable results were not obtainable.

EXAMPLE 4

Example 1 was repeated in the same manner as described except that Taiheiyo Coal (sub-bituminous coal) having the properties shown in Table 4 was used in lieu of the Backskin Coal. The results are summarized in Tables 4 and 5.

EXAMPLE 5

Example 4 was repeated in the same manner as described except that the pyrolysis was performed at 420° C. The results are summarized in Tables 4 and 5.

EXAMPLE 6

Example 4 was repeated in the same manner as described except that the pyrolysis was performed at 440° C. The results are summarized in Tables 4 and 5. The oil of the pyrolysis products had a composition shown in Table 6.

COMPARATIVE EXAMPLE 3

Example 4 was repeated in the same manner as described except that the pyrolysis was performed at 380° C. The results are summarized in Tables 4 and 5.

COMPARATIVE EXAMPLE 4

Example 4 was repeated in the same manner as described except that the pyrolysis was performed at 460° C. Desirable results were not obtainable.

TABLE 4

| Properties of Raw Coal Feed and Reformed Coal | Raw Coal Feed | Example 4 | Example 5 | Example 6 | Comparative Example 3 |
|---|---|---|---|---|---|
| Pyrolysis Temperature (° C.) | | 400 | 420 | 440 | 380 |

TABLE 4-continued

| Properties of Raw Coal Feed and Reformed Coal | Raw Coal Feed | Example 4 | Example 5 | Example 6 | Comparative Example 3 |
|---|---|---|---|---|---|
| Elementary Analysis (wt %) | | | | | |
| C | 76.4 | 80.4 | 81.4 | 84.3 | 79.6 |
| H | 6.3 | 5.3 | 5.3 | 5.0 | 5.6 |
| N | 1.4 | 1.4 | 1.4 | 1.5 | 1.3 |
| O, S, etc. | 15.9 | 12.9 | 11.9 | 9.1 | 13.4 |
| H/C Atomic Ratio | 0.98 | 0.79 | 0.79 | 0.71 | 0.85 |
| Ash Content (wt %, dry basis) | 13.80 | 21.79 | 21.41 | 24.98 | 20.30 |
| Calorific Value (kcal/kg) | 6,300 | 6,500 | 6,453 | 6,490 | 6,555 |
| Ignition Point (° C.) | 398 | 420 | 426 | 522 | 417 |

TABLE 5

| Yield of Pyrolysis Products and Composition of Gas Product | Example 4 | Example 5 | Example 6 | Comparative Example 3 |
|---|---|---|---|---|
| Pyrolysis Temperature (° C.) | 400 | 420 | 440 | 380 |
| Yield | | | | |
| Gas | 4.2 | 2.7 | 7.9 | 3.9 |
| Oil | 6.6 | 3.4 | 9.4 | 3.4 |
| Reformed coal | 85.0 | 90.1 | 76.2 | 86.6 |
| Water | 4.2 | 3.8 | 6.5 | 6.1 |
| Composition of Gas Product | | | | |
| $CO_2$ | 56.5 | 58.5 | 42.4 | 70.2 |
| $CH_4$ | 15.3 | 12.1 | 23.0 | 9.6 |
| $H_2$ | 1.60 | 0.99 | 2.90 | 0.70 |

TABLE 6

| Composition of Oil Product | |
|---|---|
| Composition of Oil | % by weight |
| Benzene | 1.9 |
| Toluene | 6.2 |
| Phenol | 2.7 |
| o-Cresol | 13.0 |
| m-Cresol | 3.8 |
| p-Cresol | 4.0 |
| 2,6-dimethylphenol | 4.4 |
| Others | 64.0 |

From the results shown in the above Tables, it will be appreciated that the calorific value of the upgraded coal is higher than the raw coal. The ignition point of the upgraded coal is also higher than the raw coal, indicating that the upgraded coal does not cause problems of spontaneous ignition during storage and transportation. Further, the oxygen content of the upgraded coal is smaller than that of the raw coal, indicating that generation of carbon dioxide can be reduced. Furthermore, the oil product obtained by the liquid phase pyrolysis contains valuable substances.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese. Patent Application No. H11-232345, filed Aug. 19, 1999, inclusive of the specification and claims, are hereby incorporated by reference herein.

What is claimed is:

1. A process of upgrading low rank coal, comprising the steps of:

forming a slurry of the rank coal dispersed in a paraffin solvent; and subjecting the low rank coal to pyrolysis in a liquid phase at a temperature of 400–450° C. to produce an upgraded coal.

2. A process as claimed in claim 1, wherein said low rank coal has a rank of coalification of 80% or less.

3. A process as claimed in claim 1, wherein said low rank coal is selected from the group consisting of sub-bituminous coal, brown coal, lignite and peat.

4. A process as claimed in claim 1, wherein said low rank coal has a particle size of 100 mm or less.

5. A process as claimed in claim 1, wherein said organic solvent is used in an amount of 0.5–2 parts by weight per part by weight of said low rank coal.

6. A process as claimed in claim 1, wherein said pyrolysis is performed at a temperature of 420–440° C.

7. A process as claimed in claim 1 wherein said paraffin solvent is decalin.

8. A process as claimed in claim 1 consisting essentially of said steps.

9. A process as claimed in claim 1 wherein said paraffin solvent comprises decalin.

10. A process as claimed in claim 1 wherein said pyrolysis is conducted at a pressure of 0.5–5 MPa.

11. A process as claimed in claim 1 wherein said pyrolysis is conducted in a nitrogen atmosphere.

12. A process as claimed in claim 1 wherein said pyrolysis is performed in the presence of at least one of a desulfurization catalyst and a denitrification catalyst.

* * * * *